United States Patent [19]

Johnson et al.

[11] Patent Number: 4,732,797

[45] Date of Patent: Mar. 22, 1988

[54] WET WIPER NATURAL ACID PRESERVATION SYSTEM

[75] Inventors: Dale H. Johnson, Greer; Joseph H. Miller, Greenville, both of S.C.; Jack H. Propp, Oshkosh; Victor Turoski, Neenah, both of Wis.

[73] Assignee: James River Corporation, Richmond, Va.

[21] Appl. No.: 19,756

[22] Filed: Feb. 27, 1987

[51] Int. Cl.[4] ..... A61K 9/70; D06M 13/20

[52] U.S. Cl. ..... 428/74; 15/104.43; 15/209 R; 128/132 D; 206/812; 424/404; 428/288; 428/289; 604/359; 604/360

[58] Field of Search ..... 15/104.43, 209 R; 128/132 D; 206/812; 424/27, 28, 31; 428/288, 289, 74; 604/359, 360

[56] References Cited

U.S. PATENT DOCUMENTS

| | | |
|---|---|---|
| 1,772,975 | 8/1930 | Wieland . |
| 2,474,306 | 6/1949 | Doub . |
| 2,702,780 | 2/1955 | Lerner . |
| 3,138,533 | 6/1964 | Helm et al. . |
| 3,227,614 | 1/1986 | Scheuer . |
| 3,257,267 | 6/1966 | Hay . |
| 3,264,172 | 8/1966 | Requtti . |
| 3,404,987 | 10/1968 | Koolstra et al. . |
| 3,567,118 | 2/1971 | Shepherd et al. . |
| 3,624,224 | 1/1971 | Wei . |
| 3,714,099 | 1/1973 | Biale et al. . |
| 3,714,100 | 1/1973 | Biale et al. . |
| 3,728,213 | 4/1973 | Hinz . |
| 3,860,709 | 1/1975 | Abbott et al. . |
| 3,922,462 | 11/1975 | Katz et al. . |
| 3,959,556 | 5/1976 | Morrison . |
| 4,111,922 | 9/1978 | Beede et al. . |
| 4,259,103 | 3/1981 | Malek et al. . |
| 4,259,383 | 3/1981 | Eggensperger et al. . |
| 4,277,529 | 7/1981 | Friedman . |
| 4,282,366 | 8/1981 | Eudy . |
| 4,311,479 | 1/1982 | Fenn et al. . |
| 4,394,378 | 7/1983 | Klein . |
| 4,401,712 | 8/1983 | Morrison . |
| 4,406,892 | 9/1983 | Eudy . |
| 4,408,996 | 10/1983 | Baldwin . |
| 4,430,381 | 2/1984 | Harvey et al. . |
| 4,533,691 | 8/1985 | Khalil et al. . |
| 4,615,937 | 10/1986 | Bouchette ..... 428/289 |

FOREIGN PATENT DOCUMENTS 2103089A 2/1983 United Kingdom .

OTHER PUBLICATIONS

J. Reid, "The Disinfectant Action of Certain Organic Acids", 16 American Journal of Hygiene, pp. 540–556 (1932).

M. S. Balsam et al., Cosmetics, Science & Technology, (vol. 3), p. 436.

J. Schimmer et al., "Preservation of Cosmetics, " Cosmetic and Drug Preservation Principles & Practices, ed. by J. Kabara, chapter 40, p. 424.

N. Kurita et al., Synergistic Antimicrobial Effect of Acetic Acid, Sodium Chloride & Essential Oil Components", 46 Agricultural Biological Chemistry, 1655–1660 (1982).

O. Littlejohn, "The Potentizing Effect of Antimolding Agents in Syrups", Journal of the Amer. Pharmaceutical Assoc., pp. 305–308 (May 1955).

Isquith et al., Surface-Bonded Antimicrobial Activity of an Organosilico Quaternary Ammonium Chloride, Appl. Microbiol. 859–863 (Dec. 1972).

Walters et al., Algicidal Activity of a Surface-Bonded Organosilicon Quaternary Ammonium Chloride, 25 Appl. Microbiol. 253–256 (1973).

*Primary Examiner*—James C. Cannon

*Attorney, Agent, or Firm*—Finnegan, Henderson, Farabow, Garrett & Dunner

[57] ABSTRACT

A wet wiper product of the type having a fibrous wipe, a liquid preservative composition, and an enclosure for the fibrous wipe and the liquid preservative composition. The liquid preservative composition consists essentially of: (a) a mixture of citric acid and sorbic acid as the preservative component; (b) water; and (c) optional ingredients selected from the group consisting of skin moisturizers and fragrance compounds.

13 Claims, No Drawings

WET WIPER NATURAL ACID PRESERVATION SYSTEM

BACKGROUND OF THE INVENTION

The present invention relates to wet wipers and, more particularly, to a wet wiper product having a liquid preservation system of citric acid and sorbic acid.

Wet wiper products require preservative properties to destroy or inhibit the growth of various microorganisms, bacteria, yeast, and molds. The use of a chemical preservative agent dispersed or dissolved in a liquid phase of a wet wiper has previously met various disadvantages because the nature of the required chemicals and the complexity of the final liquid phase formulations typically result in harsh or irritating residues being left behind on the skin of the user.

The preservative used in a wet wiper should meet two often competing criteria, namely effectiveness as a preservative and non-irritability in contact with human skin. As resistant strains to commonly utilized preservatives appear, the industry has typically increased usage levels and the number of preservative components in the wet wiper. As more potent strains of preservatives are utilized to achieve the desired effect, skin irritations and allergic reactions are often provoked in the user.

In an attempt to solve these problems, U.S. Pat. No. 4,615,937 to Michael P. Bouchette discloses that a superior wet wiper product can be produced in which the antimicrobial treatment is substantive to the wet wiper fibers. As a result of having the antimicrobial agent substantive to the fibers, no chemicals in the liquid or lotion phase of the wiper are required. Hence, no harmful residue is left on the skin of the user.

As a further improvement, U.S. patent application Ser. No. 854,811, filed on April 23, 1986 by Michael P. Bouchette et al., entitled "An Antimicrobially Active Wet Wiper" discloses a wet wiper that has both a substantive antimicrobial agent, such as an organo-silicon quaternary ammonium salt, on the fibers of the wet wiper product and a second antimicrobial agent, such as an organic acid, in the liquid or lotion phase of the wiper. This application notes that the combined use of the substantive antimicrobial agent and the antimicrobial agent in the liquid or lotion phase enhances the antimicrobial effects of the wet wiper.

These wet wipers, nevertheless, still require an antimicrobial agent substantive to the fibers of the wiper. It would be advantageous to develop a wet wiper that dispenses with the need of having such a substantive antimicrobial agent, but that does not leave a harsh or irritating residue on the user's skin.

SUMMARY OF THE INVENTION

The present invention overcomes the previous problems in the art and achieves various advantages by providing a wet wiper product of the type comprising a fibrous wipe, a liquid preservative composition, and a means enclosing the fibrous wipe in the liquid preservative composition. The liquid preservative composition consists essentially of: (a) a mixture of citric acid and sorbic acid as the preservative component; (b) water; and (c) optional ingredients selected from the group consisting of skin moisturizers and fragrance compounds.

The present inventors have discovered that such a wet wiper product has significant preservative properties, but is not irritating or harsh to the skin. The present invention achieves these advantages even though the wet wiper does not have a substantive antimicrobial agent and is maintained only in a liquid preservative composition. Indeed, these desirable properties are provided to the wet wiper product when a mixture of citric acid and sorbic acid are used as the only preservative component for the wet wiper without the need for any other preservative agents in the wet wiper product.

Consequently, the present invention does not require the inclusion in the wet wiper of an antimicrobial agent substantive to the fibers because the mixture of citric acid and sorbic acid provides all the preservative properties needed by the wet wiper. In fact, the present inventors have found that the mixture of citric acid and sorbic acid as the preservative component provides significantly better preservative properties than when either component is used alone. Importantly, there is no need in the present invention of using harsh and irritating preservatives in the wet wiper because citric acid and sorbic acid are naturally occurring and nonirritating acids that provide all the antimicrobial properties needed by the wet wiper.

The advantages of the present invention are particularly surprising because neither citric acid nor sorbic acid alone demonstrates the breadth of kill spectrum or speed as exhibited by their combination. Citric acid is not even conventionally classified as a preservative for wet wipers, but is principally used in food as an acidulant. Sorbic acid is typically used as a food preservative. When, however, the present inventors combined these acids together as a liquid preservative composition, substantial preservative capability was achieved for the wet wiper, even in the absence of any other preservative or antimicrobial agent.

This and other features and advantages of the present invention will be made more apparent from the following description of the preferred embodiments.

DESCRIPTION OF THE PREFERRED EMBODIMENTS

In accordance with the present invention, the wet wiper product comprises a fibrous wipe, a liquid preservative composition, and a means enclosing the fibrous wipe and the liquid preservative.

The fibrous wipe can be selected from those conventionally known in the art. Various synthetic and natural fibers known in the art can be effectively used. Preferred fibers are cellulosic fibers and, more preferably, wood pulp fibers. The cellulosic fibers, such as wood pulp fibers, can be chemically treated prior to the formation of the web or fabric, if desired. Examples of wood pulp fibers include various mechanical and chemical pulp fibers, such as cedar fibers, southern pine fibers, spruce fibers, and hemlock fibers. The particular fibers may be specifically selected to enhance properties such as texture (soft, wooly or fluffy), porosity, caliper, brightness, strength, and so on. Alternatively, the fibers can be a combination of natural and synthetic fibers, or synthetic fibers alone, depending upon the final attributes sought and the method of forming the web.

The weight of the fibers, such as cellulosic fibers, used to form the unbonded fibrous web can vary depending upon the ultimate non-woven web that is produced. Typically, the weight of the fibers forming the web will vary within the range of about 5 lbs. per 3000 $ft^2$ to about 60 lbs. per 3000 $ft^2$.

Various web or fabric forming techniques known in the art can be effectively used to form the unbonded fibers. The web can be formed by nonwoven techniques, such as air-laying or wet-laying the web. One type of apparatus for air forming fibers is shown in U.S. Pat. No. 4,292,271 to Buob et al. Other non-woven manufacturing techniques, such as melt blown, spunbonded, needle punched, and spun laced, may also be used.

Various binders known in the art can be used to bind the fibers together. A preferred binder is a polymeric binder, such as a latex binder. Acceptable latex binders include acrylate emulsions, butadiene-styrene emulsions, ethylene vinyl acetate emulsions and acrylonitrile-butadiene emulsions. An especially effective latex binder is ethylene vinyl acetate, which is sold under the trademark AIRFLEX A-410 by Air Products, Inc. of Allentown, Penn. The binder can also include a mixture of anionic and nonionic binders, such as an ethylene vinyl acetate binder sold under the trademark AIRFLEX A-106 by Air Products, Inc. and an ethylene acetate binder sold under the trademark HA-8 by Rohm & Haas of Philadelphia, Pa.

The amount of the binder that is to be applied to the fibers depends, in part, upon the type of fibers, such as cellulosic. Typically, the amount of the binder applied to the fibers varies within the range of about 5% to about 30% of the total web weight. Similarly, the amount of solids in the binder, as applied to the web, especially in a latex binder, depends, among other things, on the weight of the fibers in the non-woven web. Generally, latex binders having from about 5% to about 25% application solids content are used. Of course, one of ordinary skill in the art can select the particular binder, the amount of the binder used, and the amount of solids present in the binder, depending upon, in part, the type of fibers that are to be bound. The binder is applied to the fibers by various techniques known in the art, such as spraying, foaming, or padding.

In accordance with the present invention, the wet wiper product has a liquid preservative composition consisting essentially of: (a) a mixture of citric acid and sorbic acid as the preservative component; (b) water; and (c) optional ingredients selected from the group consisting of skin moisturizers and fragrance compounds. The citric acid and sorbic acid are present in the liquid preservative composition in amounts effective to act as the preservative component in the wet wiper.

The present invention achieves the desired preservative properties in a wet wiper with only citric acid and sorbic acid as the preservative component without the need for any other preservative component, such as an antimicrobial agent, in the wet wiper. Citric acid (2-hydroxy-1,2,3-propanetricarboxcylic acid) and sorbic acid (2,4-hexadienoic acid) are mild, naturally occurring organic acids that are relatively safe for skin contact and are edible. Consequently, users of the wet wiper typically do not exhibit adverse reactions to the wet wiper, even under repeated occlusive applications to human skin under conditions in which conventionally preserved products exhibit some irritation.

The sorbic acid is preferably present in the liquid preservative composition in the range of about 0.01 wt. % to about 0.20 wt. %. The citric acid is preferably present in the liquid preservative composition in the range of about 0.1 wt. % to about 0.5 wt. %. The weight ratio of citric acid to sorbic acid in the liquid preservative composition is preferably in the range of about 20 to 1 to about 1 to 1 and, most preferably, in the range of about 10 to 1 to about 3 to 1. An effective liquid preservative composition has about 0.05 wt. % to about 0.10 wt. % sorbic acid and about 0.3 wt. % to about 0.5 wt. % citric acid.

The pH of the liquid preservative composition is preferably below about 3.5. More preferably, the liquid preservative composition has a pH in the range of about 2.8 to about 3.0. Although it was previously believed that a pH of less than about 3.5 should not be used for skin contact products such as wet wipers, the present inventors have found that such a pH range for a wet wiper does not necessarily result in extensive skin or eye irritation when sorbic acid and citric acid are the only preservative components. Any such skin and eye irritation that may occur is especially minimized in the present invention because the citric acid and sorbic acid are relatively nonirritating substances.

The combination of citric acid and sorbic acid in the liquid preservation composition provides excellent preservative activity against various microorganisms, particularly the five pathogenic microorganisms identified in the U.S. patent twenty-eight day challenge test: *Aspergillus niger, Candida albicans, Staphylococcus aureus, Pseudomonas aeruginosa, and Escherichia coliformia.* Neither component alone demonstrates the breadth of kill spectrum or speed as the combination of the citric and sorbic acids.

The liquid preservative composition in the present invention also includes water and optional ingredients selected from the group consisting of skin moisturizers and fragrance compounds. Pure water that is safe for skin contact is preierred. The liquid preservative composition need not include any skin moisturizers or fragrance compounds since these are optional ingredients. The wt. % total of the preservative component, water, and the optional ingredients is 100 wt. %.

The skin moisturizers can be selected from various moisturizers well known in the art, such as aloe vera, lecithin, lanolin and lanolin derivatives. Other skin moisturizers known in the art can also be readily used in amounts known in the art to achieve the intended purpose of moisturizing the skin upon use. In one embodiment, an effective amount of aloe vera could be used as a skin moisturizer.

Similarly, fragrance compounds, such as water soluble fragrance compounds, can be used. Such fragrance compounds are well known and conventionally used in the art. For example, fragrance compounds can be readily obtained from International Food and Flavor, Inc. (I.F.F.) The proper fragrance compound can be selected by one skilled in the art without undue experimentation.

In accordance with the present invention, a means encloses the fibrous wipe in the liquid preservative composition. In one embodiment of the present invention, the enclosure means for the fibrous wipe is a sealed package or sealed envelope, of the type conventionally used in the art, to enclose the fibrous wipe in the liquid preservative composition until the time of use. The fibrous wipe and preservative composition can be sealed within the enclosure by various techniques well known in the art. Other enclosure means well known in the art can also be used.

In one embodiment of the present invention, the wet wiper product comprises: (1) a latex bonded cellulosic fiber wipe; (2) a liquid preservative composition consisting essentially of (i) 0.4 wt. % citric acid, (ii) 0.05 wt. % sorbic acid, (iii) an effective amount of aloe vera, (iv) an effective amount of a fragrance compound, and (v) water to 100 wt. %; and (3) an outer sealed package enclosing the wet wipe to maintain the wet wipe in the liquid preservative composition until use.

The following is an example of the present invention, and is intended to be merely exemplary.

EXAMPLE

A wet wiper product comprising (1) a latex bonded cellulosis fiber wipe; (2) a liquid preservative composition consisting essentially of 0.055 wt. % sorbic acid, 0.37 wt. % citric acid, 0.2 wt. % of a fragrance compound, and water to 100 wt. %; and (3) an outer sealed packaqe enclosing the wet wipe was prepared. The wet wiper product was tested the U.S. patent procedure for the twenty-eight challenge test to determine the preservative activity of the wet wiper against various microorganisms. The wet wiper was found to exceed the efficacy standards for the minimum inhibitory concentration (MIC) for the five pathogenic microorganisms identified in the test: *Aspergillus niger, Candida albicans, Staphylococcus aureus, pseudomonas aeruginosa,* and *Escherichia coliformia.*

Other embodiments of the invention will be apparent to one skilled in the art from a consideration of the specification or with the practice of the disclosed invention. It is intended that the specification and example be considered as exemplary only with the true scope and spirit of the invention being indicated by the claims.

What is claimed is:

1. In a wet wiper product of the type comprising a fibrous wipe, a liquid preservative composition, and a means enclosing the fibrous wipe and the liquid preservative composition, the improvement comprising a liquid preservative composition consisting essentially of:

(a) a mixture of citric acid and sorbic acid as the preservative component;

(b) water; and (c) optional ingredients selected from the group consisting of skin moisturizers and fragrance compounds.

2. The wet wiper product of claim 1, wherein the sorbic acid is present in the liquid preservative composition in the range of about 0.01 wt. % to about 0.20 wt. %.

3. The wet wiper product of claim 1, wherein the citric acid is present in the liquid preservative composition in the range of about 0.1 wt. % to about 0.5 wt. %.

4. The wet wiper product of claim 1, wherein the sorbic acid is present in the liquid preservative composition in the range of about 0.01 wt. % to about 0.20 wt. % and the citric acid is present in the liquid preservative composition in the range of about 0.1 wt. % to about 0.5 wt. %.

5. The wet wiper product of claim 1, wherein the weight percent ratio of citric acid to sorbic acid in the liquid preservative composition is in the range of about 20 to 1 to about 1 to 1.

6. The wet wiper product of claim 1, wherein the liquid preservative composition has about 0.05 wt. % to about 0.10 wt. % sorbic acid and about 0.3 wt. % to about 0.5 wt. % citric acid.

7. The wet wiper product of claim 1, wherein the pH of the liquid preservative composition is below about 3.5.

8. The wet wiper product of claim 1, wherein the pH of the liquid preservative composition is in the range of about 2.8 to about 3.0.

9. The wet wiper product of claim 1, wherein the fibrous wipe comprises fibers selected from the group consisting of cellulosic fibers, synthetic fibers, and combinations thereof.

10. The wet wiper product of claim 9, wherein the fibers are bound with a polymeric binder.

11. The wet wiper product of claim 10, wherein the polymeric binder is a latex binder.

12. The wet wiper product of claim 1, wherein the fibrous wipe is air-laid.

13. The wet wiper product of claim 1, wherein the fibrous wipe is wet-laid.

* * * * *

UNITED STATES PATENT AND TRADEMARK OFFICE

CERTIFICATE OF CORRECTION

PATENT NO. : 4,732,797

DATED : March 22, 1988

INVENTOR(S) : Dale H. JOHNSON et al.

It is certified that error appears in the above-identified patent and that said Letters Patent is hereby corrected as shown below:

Column 4, line 23, change "U.S. patent" to --U.S. Pharmacopeia or U.S.P.--.

Column 4, line 50, change "International Food and Flavor" to --International Flavors and Fragrances--.

Column 5, line 12, change "cellulosis" to --cellulosic--.

Column 5, line 17, change "U.S. patent" to --U.S. Pharmacopeia or U.S.P.--.

Column 5, line 18, change "twenty-eight challenge" to --twenty-eight day challenge--.

Signed and Sealed this

Fourth Day of July, 1989

*Attest:*

*Attesting Officer*

DONALD J. QUIGG

*Commissioner of Patents and Trademarks*